US008172388B2

(12) United States Patent
Wanibe

(10) Patent No.: US 8,172,388 B2
(45) **Date of Patent: *May 8, 2012**

(54) LIQUID CONTAINER

(75) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 344 days.

This patent is subject to a terminal disclaimer.

(21) Appl. No.: 12/473,786

(22) Filed: May 28, 2009

(65) Prior Publication Data

US 2009/0295891 A1 Dec. 3, 2009

(30) Foreign Application Priority Data

May 29, 2008 (JP) ..... 2008-140414

(51) Int. Cl.
*B41J 2/19* (2006.01)

(52) U.S. Cl. ..... 347/92; 347/85; 347/86; 347/84

(58) Field of Classification Search ..... None
See application file for complete search history.

(56) References Cited

U.S. PATENT DOCUMENTS

| | | | | |
|---|---|---|---|---|
| 6,217,164 | B1 | 4/2001 | Hino | |
| 6,520,632 | B1 | 2/2003 | Yamazaki et al. | |
| 7,419,253 | B2 * | 9/2008 | Olsen et al. | 347/86 |
| 7,942,510 | B2 | 5/2011 | Shinada et al. | |
| 2006/0203053 | A1 | 9/2006 | Katsumura | 347/86 |
| 2009/0015644 | A1 | 1/2009 | Shinada et al. | |

FOREIGN PATENT DOCUMENTS

| | | |
|---|---|---|
| JP | 2000-177144 A | 6/2000 |
| JP | 2004-276620 A | 10/2004 |
| JP | 2006-198845 A | 8/2006 |
| JP | 2006-248201 | 9/2006 |
| JP | 2008-044193 A | 2/2008 |
| JP | 2008-044195 A | 2/2008 |

OTHER PUBLICATIONS

Office Action for U.S. Appl. No. 12/469,532 dated Jun. 23, 2011.

* cited by examiner

*Primary Examiner* — Matthew Luu
*Assistant Examiner* — Erica Lin

(57) ABSTRACT

A liquid container mountable in a liquid ejecting apparatus is provided. The liquid container includes a liquid storage section that stores liquid, a liquid supply section through which the liquid stored in the liquid storage section is supplied to the liquid ejecting apparatus, an air communication section that allows the liquid storage section and an outside of the liquid container to communicate with each other, a bubble separation section that separates bubbles from the liquid, a vertical communication path that has an entrance communicating with the liquid storage section and an exit provided at a higher level in a vertical direction than the entrance and communicating with the bubble separation section, and a detection section that communicates with the liquid supply section and the bubble separation section and is adapted to detect a depletion of the liquid stored in the liquid container.

8 Claims, 12 Drawing Sheets

LIQUID CONTAINER

BACKGROUND

1. Technical Field

The present invention relates to liquid containers that store liquid to be supplied to liquid ejecting apparatuses.

2. Related Art

Examples of liquid containers to be mounted in liquid ejecting apparatuses include ink cartridges to be mounted in ink jet printers. In particular, ink cartridges having ink sensors that detect the amount of ink stored therein are practically in use. In general, an ink sensor detects whether or not ink is present in a sensor chamber communicating with an ink storage section. Specifically, the ink sensor detects the presence/absence of ink on the basis of physical properties of ink, or liquid, and air: for example, the difference in vibration frequency specific to a system including the sensor chamber, and the difference in refractive index of light passing through the sensor chamber. This leads to a problem that, if bubbles are contained in the ink in the sensor chamber, detection accuracy may be deteriorated. To solve this problem, JP-A-2006-248201 discloses an exemplary technique in which a bubble-trapping section is provided between the sensor chamber and the ink storage section, whereby entry of bubbles into the sensor chamber is suppressed.

However, in the known technique in which the bubble-trapping section is constituted by a flow path exposed at and extending parallel to the bottom surface of the ink cartridge and a covering member covering the flow path airtight, most of the flow path is covered with the covering member, which has a flexibility. This leads to some problems in that the pressure inside the flow path changes frequently, resulting in insufficient bubble-capturing capability, and that the flow path needs to be covered airtight with the covering member dedicated thereto, resulting in increase in the number of manufacturing steps and the manufacturing cost. In addition, depending on the orientation of the ink cartridge, entry of bubbles into the sensor chamber cannot be suppressed sufficiently.

The foregoing problems do not only apply to ink cartridges but are common to various liquid containers that are used for supplying liquid to liquid ejecting apparatuses, such as liquid containers that supply liquid materials containing metal to ejection apparatuses that eject the liquid materials onto semiconductors so as to form electrode layers.

SUMMARY

An advantage of some aspects of the invention is that it provides a liquid container having a detecting section in which entry of bubbles into the detecting section is suppressed or prevented.

To solve at least some of the problems described above, the invention takes various modes as described below.

According to an aspect of the invention, a liquid container mountable in a liquid ejecting apparatus is provided. The liquid container includes a liquid storage section that stores liquid, a liquid supply section through which the liquid stored in the liquid storage section is supplied to the liquid ejecting apparatus, an air communication section that allows the liquid storage section and an outside of the liquid container to communicate with each other, a bubble separation section that separates bubbles from the liquid, a vertical communication path that has an entrance communicating with the liquid storage section and an exit provided at a higher level in a vertical direction than the entrance and communicating with the bubble separation section, and a detection section that communicates with the liquid supply section and the bubble separation section and detects an amount of the liquid stored in the liquid container.

In the liquid container according to the above aspect, the vertical communication path has the exit provided at a higher level in the vertical direction than the entrance and communicating with the bubble separation section. Therefore, in the liquid container having the detection section, entry of bubbles into the detection section can be suppressed or prevented.

In the liquid container according to the above aspect, the vertical communication path may have a spiral shape extending from the entrance to the exit. In that case, the vertical communication path can have a sufficient length in a small space, and, regardless of the orientation of the liquid container, movement of bubbles can be suppressed or prevented.

In the liquid container according to the above aspect, the vertical communication path may include a plurality of cylindrical segments that each extend in a direction intersecting the vertical direction and are staggered with respect to the vertical direction, and at least one connecting segment that connects the cylindrical segments to each other so as to obtain a single flow path. In that case, the vertical communication path can be formed easily and be provided with a cross section having few or no sharp edges. Therefore, the flow of the liquid between the bubble separation section and the liquid storage section through such sharp edges can be suppressed or prevented. In addition, the cylindrical segments are arranged so that the end faces thereof are staggered with respect to the vertical direction. In this case, if the orientation of the liquid container is changed, bubbles cannot move from one of the cylindrical segment to another unless the bubbles first move downward in the direction of gravity. Since air having smaller specific gravity than liquid cannot move downward in the direction of gravity, movement of bubbles toward the detection section is prevented.

In the liquid container according to the above aspect, the cylindrical segments may each have at one end thereof a narrow portion having a smaller cross section, intersecting a flow direction, than the other portions of the cylindrical segments. With the narrow portion, the flow of liquid between the bubble separation section and the liquid storage section can be suppressed or prevented at the connection between the connecting segment and each cylindrical segment.

In the liquid container according to the above aspect, the vertical direction may correspond to a direction in which, in a state where the liquid container is mounted in the liquid ejecting apparatus, a bottom face of the liquid container having the liquid supply section faces downward. By orienting the liquid container such that the bottom face thereof faces downward in the vertical direction, the flow of liquid can be facilitated.

In the liquid container according to the above aspect, in an orientation of the liquid container other than an orientation where the bottom face faces downward, the vertical communication path may have a bubble-movement-suppressing configuration in which movement of bubbles contained in the liquid therein into the bubble separation chamber is suppressed. In that case, even in a state where the liquid container has been removed from the liquid ejecting apparatus, movement of bubbles between the bubble separation section and the liquid storage section can be suppressed or prevented.

In the liquid container according to the above aspect, the bubble-movement-suppressing configuration may include a portion that, in the orientation of the liquid container other than the orientation where the bottom face faces downward, extends downward in a direction of gravity. In that case, since air having smaller specific gravity than liquid cannot move downward in the direction of gravity, movement of bubbles between the bubble separation section and the liquid storage section can be suppressed or prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the drawings. Hereafter in this specification, an ink cartridge will be taken as an example of a liquid container.

Configuration of Ink Cartridge

Figure 1:
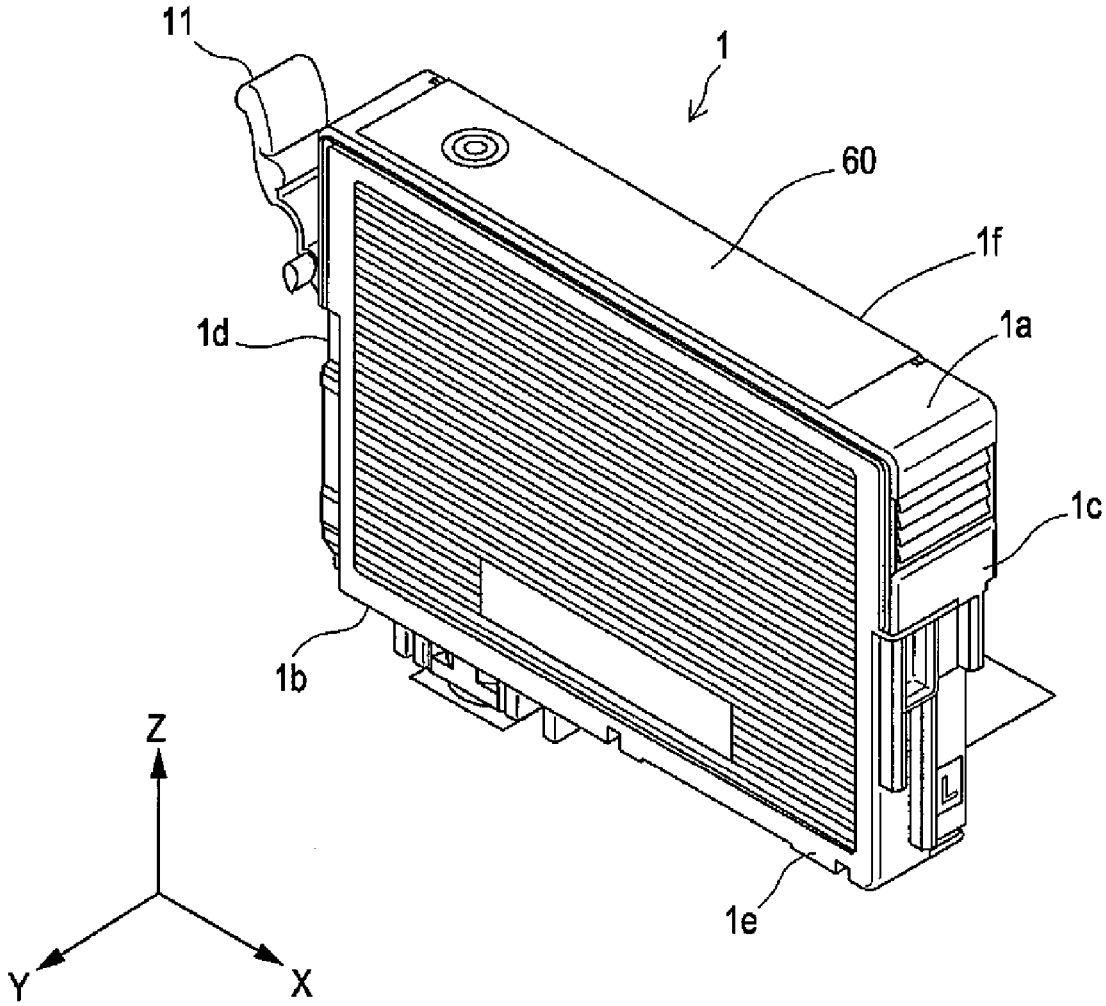
FIG. 1 is an external perspective view of an ink cartridge, as a liquid container, according to an embodiment of the invention.
Figure 2:
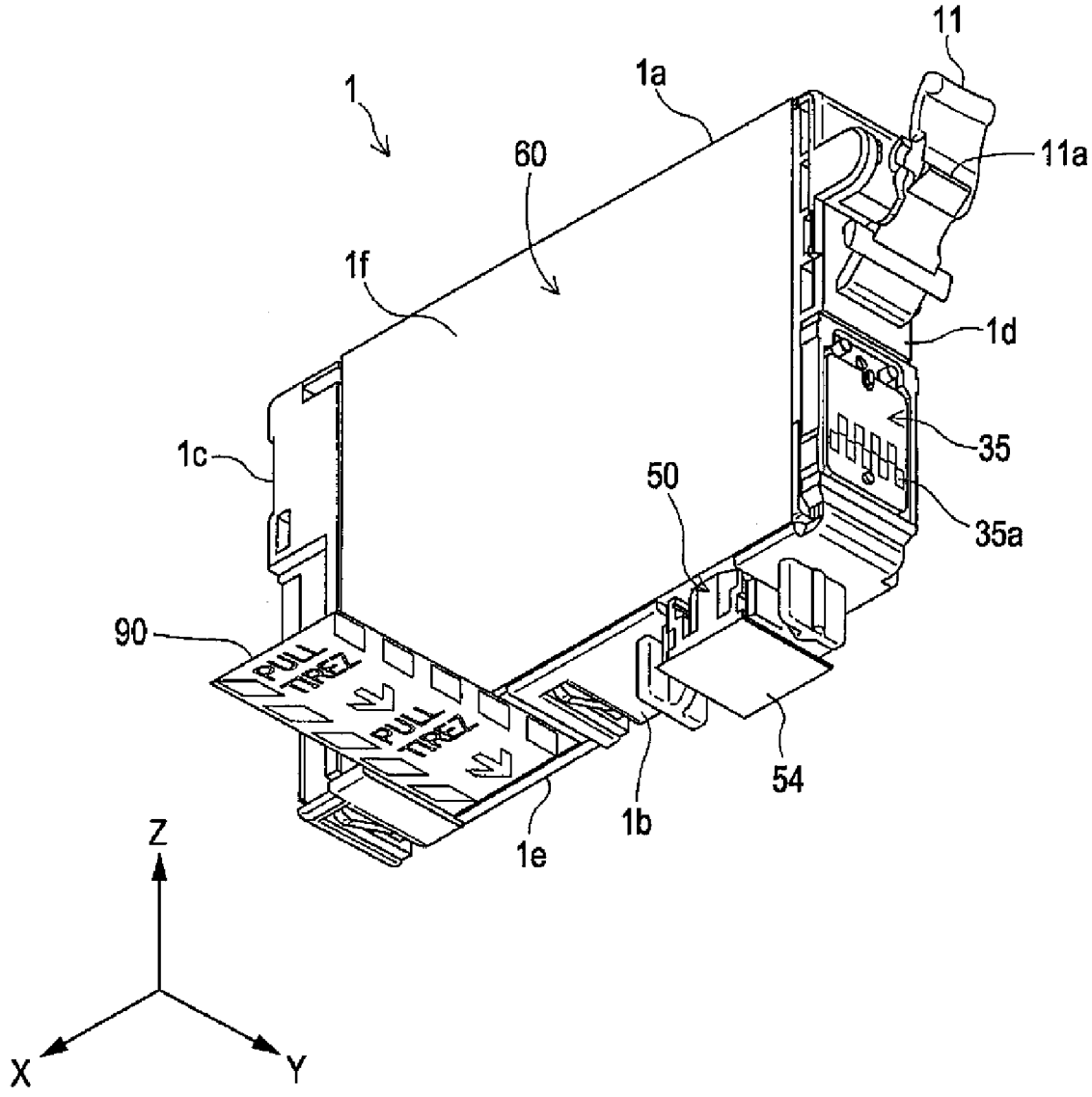
FIG. 2 is another external perspective view of the ink cartridge according to the embodiment shown in FIG. 1, seen from the back thereof.
Figure 3:
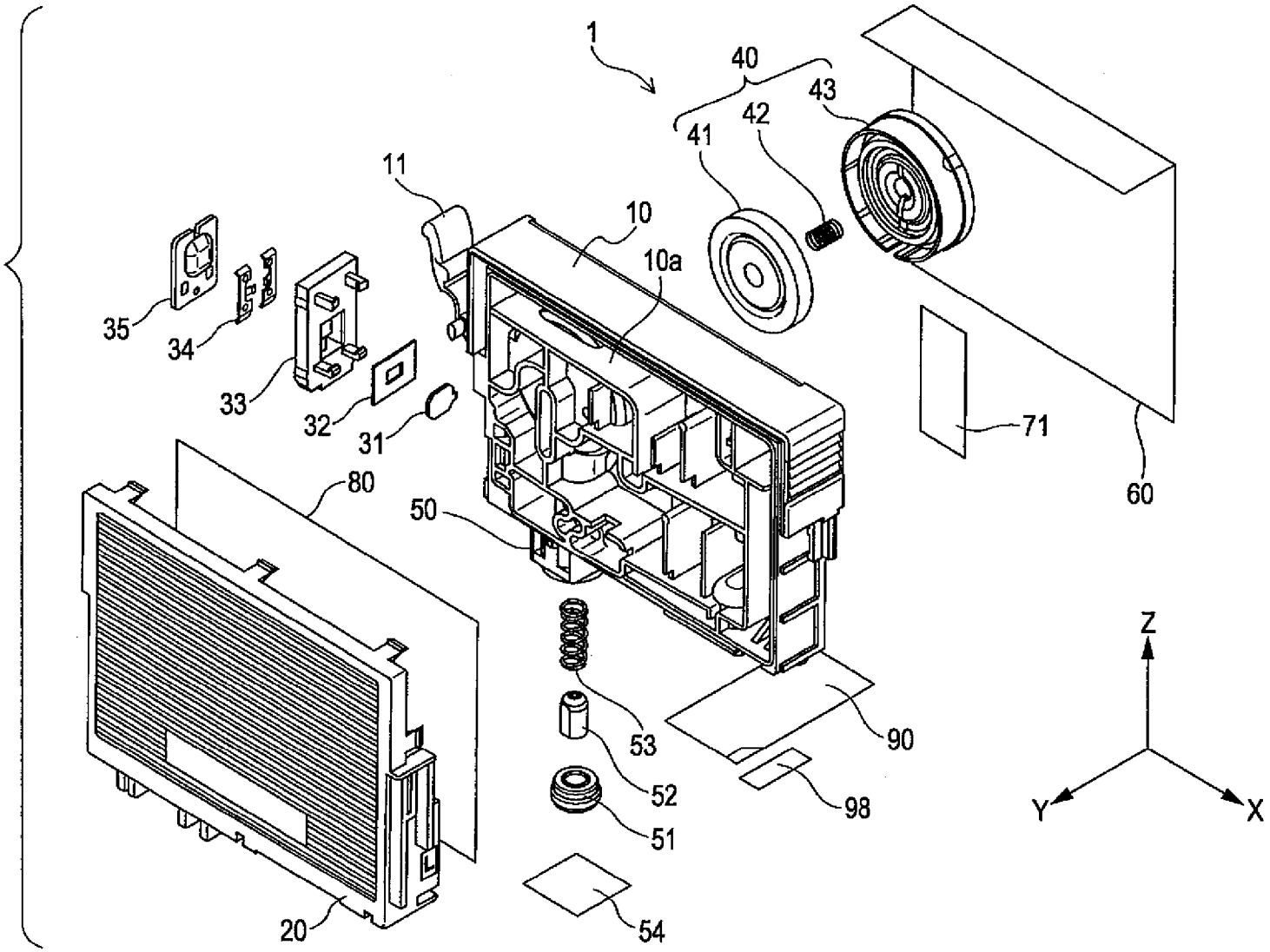
FIG. 3 is an exploded perspective view of the ink cartridge according to the embodiment, corresponding to FIG. 1.
Figure 4:
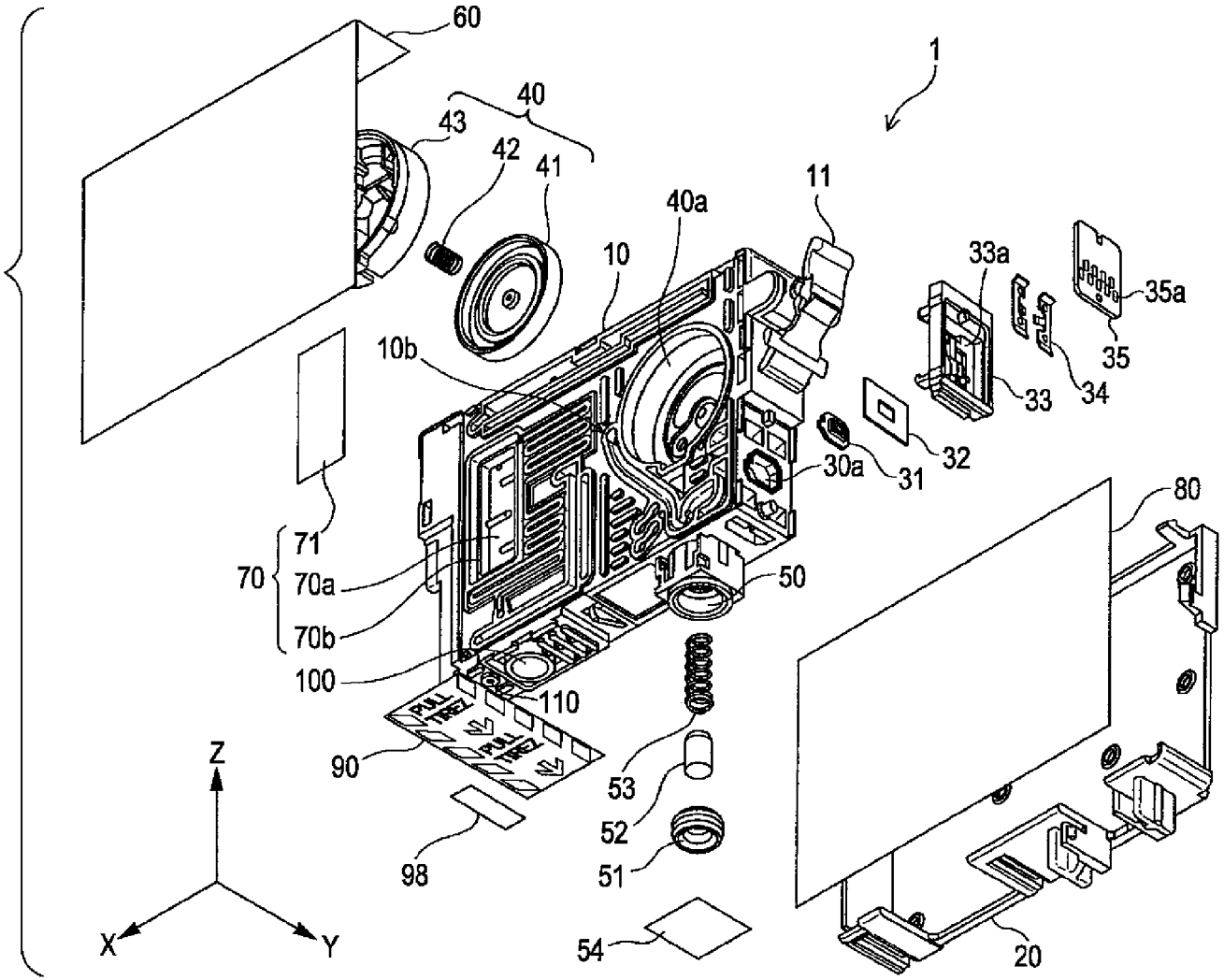
FIG. 4 is another exploded perspective view of the ink cartridge according to the embodiment, corresponding to FIG. 2.
Figure 5:
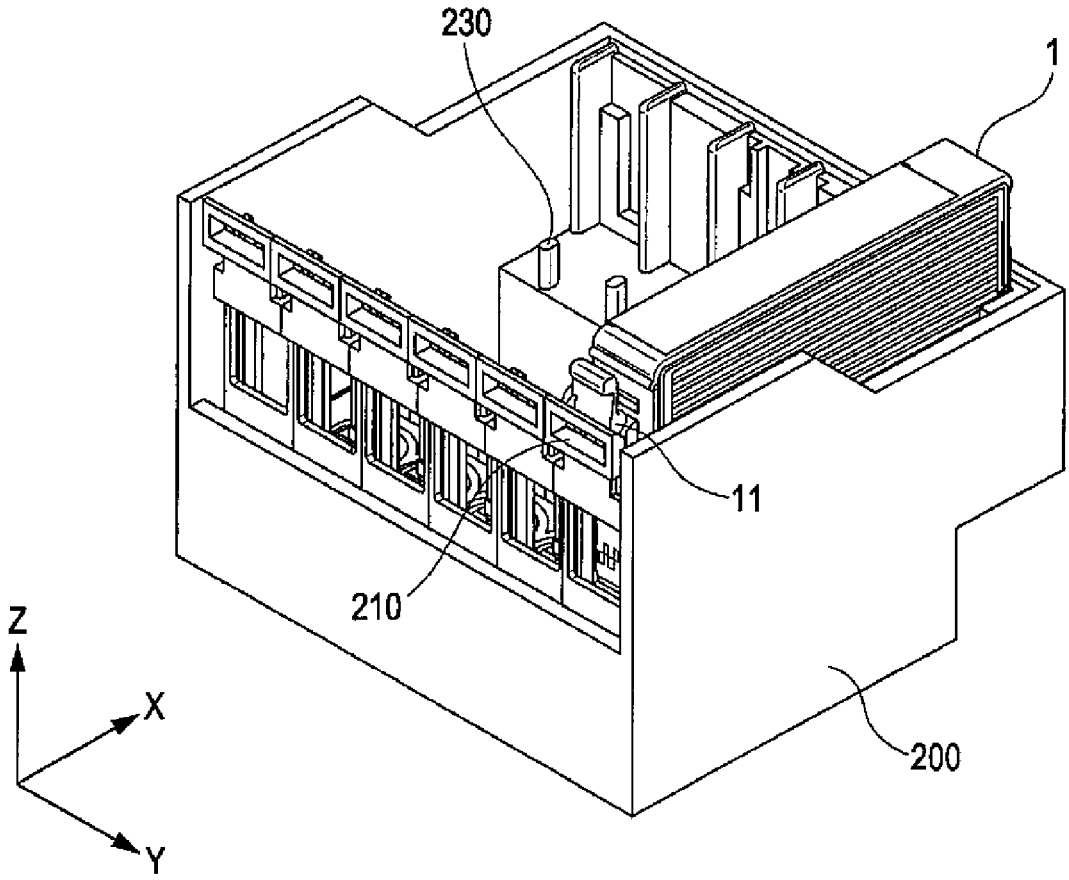
FIG. 5 shows a state where the ink cartridge according to the embodiment is mounted on a carriage.

FIG. 1 is an external perspective view of an ink cartridge, as a liquid container, according to an embodiment of the invention. FIG. 2 is another external perspective view of the ink cartridge according to the embodiment shown in FIG. 1, seen from the back thereof. FIG. 3 is an exploded perspective view of the ink cartridge according to the embodiment, corresponding to FIG. 1. FIG. 4 is another exploded perspective view of the ink cartridge according to the embodiment, corresponding to FIG. 2. FIG. 5 shows a state where the ink cartridge according to the embodiment is mounted on a carriage. In FIGS. 1 to 5, the X, Y, and Z axes are shown for easier recognition of the position (orientation) of the ink cartridge.

An ink cartridge 1 stores liquid ink thereinside. Referring to FIG. 5, the ink cartridge 1 is mounted on a carriage 200 of an ink jet printer, for example, and supplies the ink to the ink jet printer. Although FIG. 5 shows the ink cartridge 1 mounted on the carriage 200 (a so-called on-carriage type), the ink cartridge 1 may alternatively be mounted on a mount provided at a separate position from the carriage 200 (a so-called off-carriage type).

Referring to FIGS. 1 and 2, the ink cartridge 1 is substantially a rectangular parallelepiped and has a face 1*a* on the positive side in the Z-axis direction, a face 1*b* on the negative side in the Z-axis direction, a face 1*c* on the positive side in the X-axis direction, a face 1*d* on the negative side in the X-axis direction, a face 1*e* on the positive side in the Y-axis direction, and a face 1*f* on the negative side in the Y-axis direction. Hereinafter, for convenience of description, the faces 1*a*, 1*b*, 1*c*, 1*d*, 1*e*, and 1*f* are also referred to as a top face, a bottom face, a right side face, a left side face, a front face, and a back face, respectively. Further, the sides near the faces 1*a* to 1*f* are also referred to as an upper side, a lower side, a right side, a left side, a front side, and a back side, respectively.

Referring to FIGS. 4 and 5, there are provided on the bottom face 1*b*, corresponding to a bottom face of the ink cartridge 1 mounted on the ink jet printer, a liquid supply section 50 having a supply hole through which ink is supplied to the ink jet printer, and an air release hole 100 through which air is introduced into the ink cartridge 1.

The air release hole 100 has such a depth and a diameter that a projection 230 (refer to FIG. 5) provided on the carriage 200 of the ink jet printer can be fitted therein with a predetermined allowance. A user can mount the ink cartridge 1 onto the carriage 200 after removing a sealing film 90 that seals the air release hole 100 airtight. The projection 230 is intended to prevent the user's forgetting to remove the sealing film 90.

Referring to FIGS. 1 and 2, a locking lever 11 is provided on the left side face 1*d*. The locking lever 11 has a projection 11*a*. When the ink cartridge 1 is mounted onto the carriage 200, the projection 11*a* engages a recess 210 (refer to FIG. 5) provided in the carriage 200, whereby the ink cartridge 1 is fixed to the carriage 200. The carriage 200 serves as a mount on which the ink cartridge 1 is mounted. When the ink jet printer performs printing, the carriage 200 reciprocates together with a printhead (not shown) in a width direction of a print medium (a main scanning direction indicated as the Y-axis direction in FIG. 5).

Referring to FIG. 2, a circuit board 35 is provided below the locking lever 11 on the left side face 1*d*. The circuit board 35 has a plurality of electrode terminals 35*a*. The electrode terminals 35*a* are electrically connected to the ink jet printer via electrode terminals (not shown) provided on the carriage 200.

The top face 1*a* and the back face if of the ink cartridge 1 are covered with an outer surface film 60 pasted thereover.

Referring to FIGS. 3 and 4, the internal configuration of the ink cartridge 1 and the configurations of individual components will now be described. The ink cartridge 1 has a cartridge body 10 and a covering member 20 that covers the front side of the cartridge body 10.

Referring to FIG. 3, the cartridge body 10 has on the front side thereof ribs 10*a* having various shapes. A film 80 is interposed between the cartridge body 10 and the covering member 20 so as to cover the front side of the cartridge body 10. The film 80 is pasted on the front-side ends of the ribs 10*a* tightly with no gaps therebetween. The ribs 10*a* and the film 80 in combination constitute a plurality of small chambers, including a tank chamber, an end chamber, and a buffer chamber described below, sectioned in the ink cartridge 1.

Referring to FIG. 4, the cartridge body 10 has on the back side thereof a differential-pressure-valve-housing chamber 40*a* and an air-liquid separation chamber 70*a*. The differential-pressure-valve-housing chamber 40*a* houses a differential pressure valve 40 that includes a valve member 41, a spring 42, and a spring washer 43. The air-liquid separation chamber 70*a* has on the inner wall surrounding the bottom thereof a stepped portion 70*b*, on which an air-liquid separation film 71 is pasted. The air-liquid separation chamber 70*a*, the stepped portion 70*b*, and the air-liquid separation film 71 constitute an air-liquid separation filter 70.

Referring to FIG. 4, the cartridge body 10 also has on the back side thereof a plurality of grooves 10*b*. In a state where the outer surface film 60 is pasted substantially all over the back side of the cartridge body 10, the grooves 10*b* serve as various flow paths described below, such as flow paths through which ink and air flows, provided between the cartridge body 10 and the outer surface film 60.

The configuration around the circuit board 35 will now be described. Referring to FIG. 4, the cartridge body 10 has in a lower region on the left side thereof a sensor-housing chamber 30*a*. The sensor-housing chamber 30*a* houses a remaining-liquid-amount sensor 31, which is bonded thereto with a film 32. The sensor-housing chamber 30*a* has an opening on the left side. The opening is covered with a covering member 33. The covering member 33 secures on an outer surface 33*a* thereof the circuit board 35 with a junction terminal 34 interposed therebetween. A set of the sensor-housing chamber 30*a*, the remaining-liquid-amount sensor 31, the film 32, the covering member 33, the junction terminal 34, and the circuit board 35 is also referred to as a detection (sensor) section 30.

Although details are not shown, the remaining-liquid-amount sensor 31 includes a cavity constituting a part of an ink flow path section, which will be described below, a vibrating plate constituting a part of walls of the cavity, and a piezoelectric element provided on the vibrating plate. A terminal of the piezoelectric element is electrically connected to any of the electrode terminals 35*a* on the circuit board 35. In the state where the ink cartridge 1 is mounted in the ink jet printer, the terminal of the piezoelectric element is electrically connected to the ink jet printer via the electrode terminal 35*a* on the circuit board 35. When electric energy is fed from the ink jet printer to the piezoelectric element, the vibrating plate can be vibrated by the piezoelectric element. Thus, the ink jet printer can detect the presence/absence of ink in the cavity by detecting through the piezoelectric element a characteristic (the frequency, for example) of residual vibration in the vibrating plate. Specifically, detection is performed by utilizing variations in the vibration frequency of the vibrating plate (the frequency of a detection signal) between a case where ink is present in the cavity and a case where ink is absent in the cavity. When all of the ink stored in the cartridge body 10 is consumed, the interior of the cavity that has been filled with the ink becomes filled with air. This changes the characteristic of the residual vibration in the vibrating plate. Such a change in the vibration characteristic is detected by the remaining-liquid-amount sensor 31. Thus, the ink jet printer can detect the presence/absence of ink in the cavity, that is, whether or not ink remains in the ink cartridge 1.

The circuit board 35 is provided with a rewritable nonvolatile memory, such as an electronically erasable and programmable read-only memory (EEPROM), in which the amount of ink remaining in or consumed from the ink cartridge 1, the type of ink, the date of manufacture, and so forth are stored.

Referring to FIG. 4, the cartridge body 10 has at the bottom thereof a depressurization hole 110, in addition to the liquid supply section 50 and the air release hole 100 described above. The depressurization hole 110 is used for reducing the pressure inside the ink cartridge 1 by means of vacuuming when ink is injected thereinto in a process of manufacturing the ink cartridge 1.

At the completion of manufacture of the ink cartridge 1, the liquid supply section 50, the air release hole 100, and the depressurization hole 110 are sealed with a sealing film 54, the sealing film 90, and a sealing film 98, respectively. As mentioned above, the sealing film 90 is removed by the user before the ink cartridge 1 is mounted on the carriage 200 of the ink jet printer, whereby the air release hole 100 is exposed to the outside, and air is introduced into the ink cartridge 1. The sealing film 54 is broken by an ink supply needle 240 (refer to FIG. 6) provided on the carriage 200 when the ink cartridge 1 is mounted onto the carriage 200 of the ink jet printer.

The liquid supply section 50 houses, in order from the bottom, a sealing member 51, a spring washer 52, and a closure spring 53. In a state where the ink supply needle 240 is placed inside the liquid supply section 50, the sealing member 51 seals between the inner wall of the liquid supply section 50 and the outer wall of the ink supply needle 240 so as not to allow a gap therebetween. In a state where the ink cartridge 1 is not mounted on the carriage 200, the spring washer 52 is in contact with the inner wall of the sealing member 51, thereby closing the liquid supply section 50. The closure spring 53 urges the spring washer 52 in such a direction that the spring washer 52 comes into contact with the inner wall of the sealing member 51. When the ink supply needle 240 of the carriage 200 is introduced into the liquid supply section 50, the tip of the ink supply needle 240 pushes up the spring washer 52, whereby a gap is produced between the spring washer 52 and the sealing member 51. Ink is supplied through this gap to the ink supply needle 240.

Figure 6:
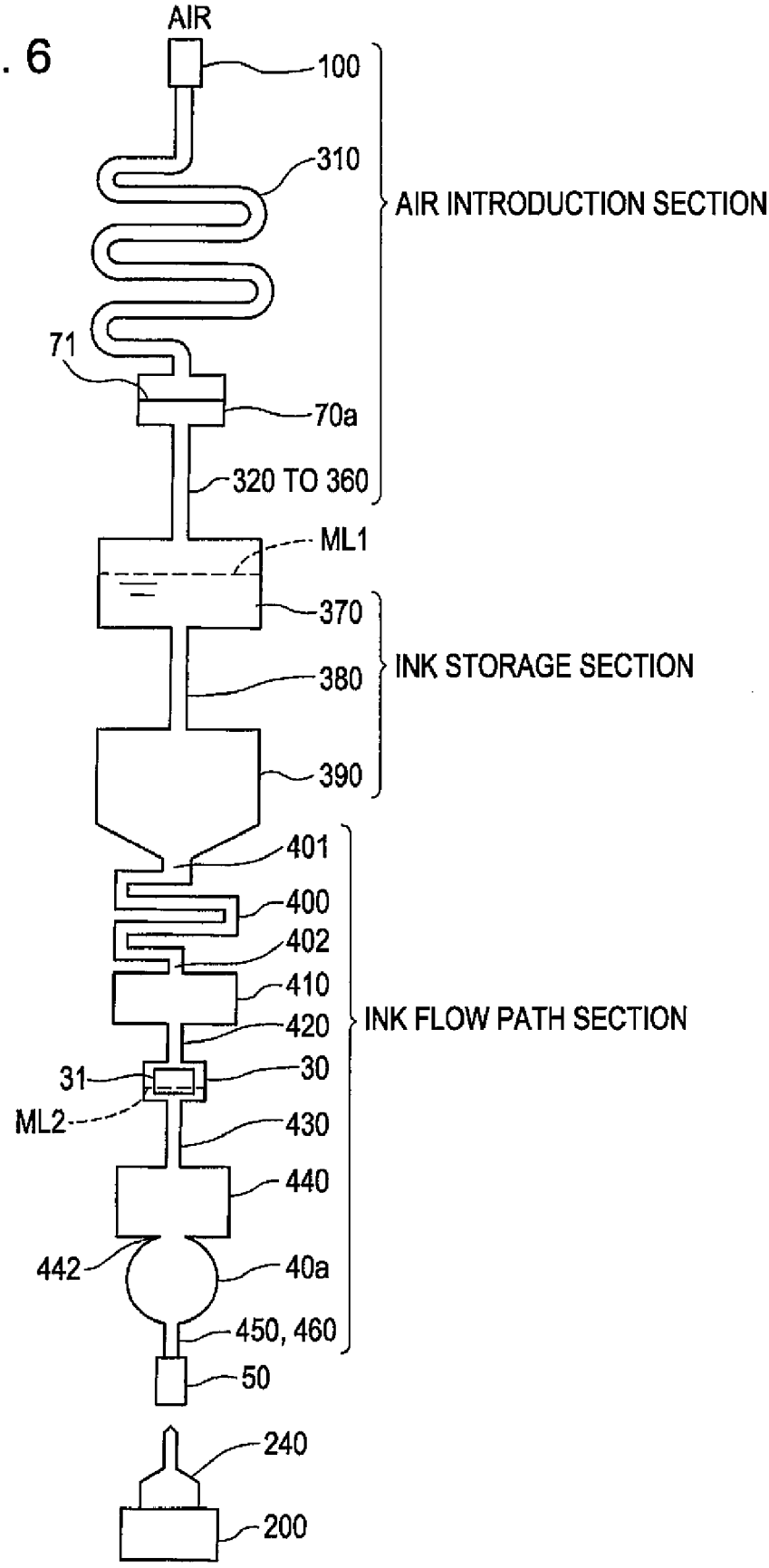
FIG. 6 is a conceptual diagram of a path extending from an air release hole to a liquid supply section of the ink cartridge according to the embodiment.

Before providing further details about the internal configuration of the ink cartridge 1, for easier understanding thereof, a path extending from the air release hole 100 to the liquid supply section 50 will now be described conceptually with reference to FIG. 6. FIG. 6 is a conceptual diagram of the path extending from the air release hole 100 to the liquid supply section 50.

The path from the air release hole 100 to the liquid supply section 50 is roughly divided into the following: an ink storage section in which ink is stored, an air introduction section (air communication section) provided on the upstream side with respect to the ink storage section, and the ink flow path section provided on the downstream side with respect to the ink storage section.

The ink storage section includes, in order from the upstream side, a tank chamber 370 serving as a first liquid-storage chamber, an inter-chamber communication path 380, and an end chamber 390 serving as a second liquid-storage chamber. The tank chamber 370 and the end chamber 390, or the first and second liquid-storage chambers, are not necessarily provided separately, and may be integrated into a single liquid-storage chamber. Alternatively, three or more liquid-storage chambers may be provided. In general, by providing separate liquid-storage chambers, the influence of changes in the volume of the air contained in the storage chambers occurring because of changes in ambient temperature or the like can be suppressed (or shared therebetween). The inter-chamber communication path 380 communicates at the upstream end thereof with the tank chamber 370, and at the downstream end thereof with the end chamber 390.

The air introduction section includes, in order from the upstream side, a meandering path 310, the air-liquid separation chamber 70*a* in which the air-liquid separation film 71 is provided, and air chambers 320 to 360 through which the air-liquid separation chamber 70*a* and the ink storage section are connected to each other. The air introduction section serves as an air communication section that allows the outside of the ink cartridge 1 and the ink storage section to communicate with each other. The meandering path 310 communicates at the upstream end thereof with the outside through the air release hole 100, and at the downstream end thereof with the air-liquid separation chamber 70*a*. The meandering path 310 has a narrow, meandering shape so that the distance from the air release hole 100 to the first liquid-storage chamber becomes long. In this manner, evaporation of moisture contained in the ink stored in the ink storage section can be suppressed. The air-liquid separation film 71 is made of a material that allows air passage but blocks liquid. With the air-liquid separation film 71 sectioning the air-liquid separation chamber 70*a* into the upstream portion and the downstream portion, ink flowing backward from the ink storage section can be prevented from flowing upstream beyond the air-liquid separation chamber 70*a*. The specific configuration of the air chambers 320 to 360 will be described separately below.

The ink flow path section includes, in order from the upstream side, a vertical communication path 400, a bubble separation chamber 410, a first flow path 420, the sensor section 30, a second flow path 430, a buffer chamber 440, the differential-pressure-valve-housing chamber 40*a* that houses the differential pressure valve 40, a third flow path 450, and a fourth flow path 460.

Figure 7:
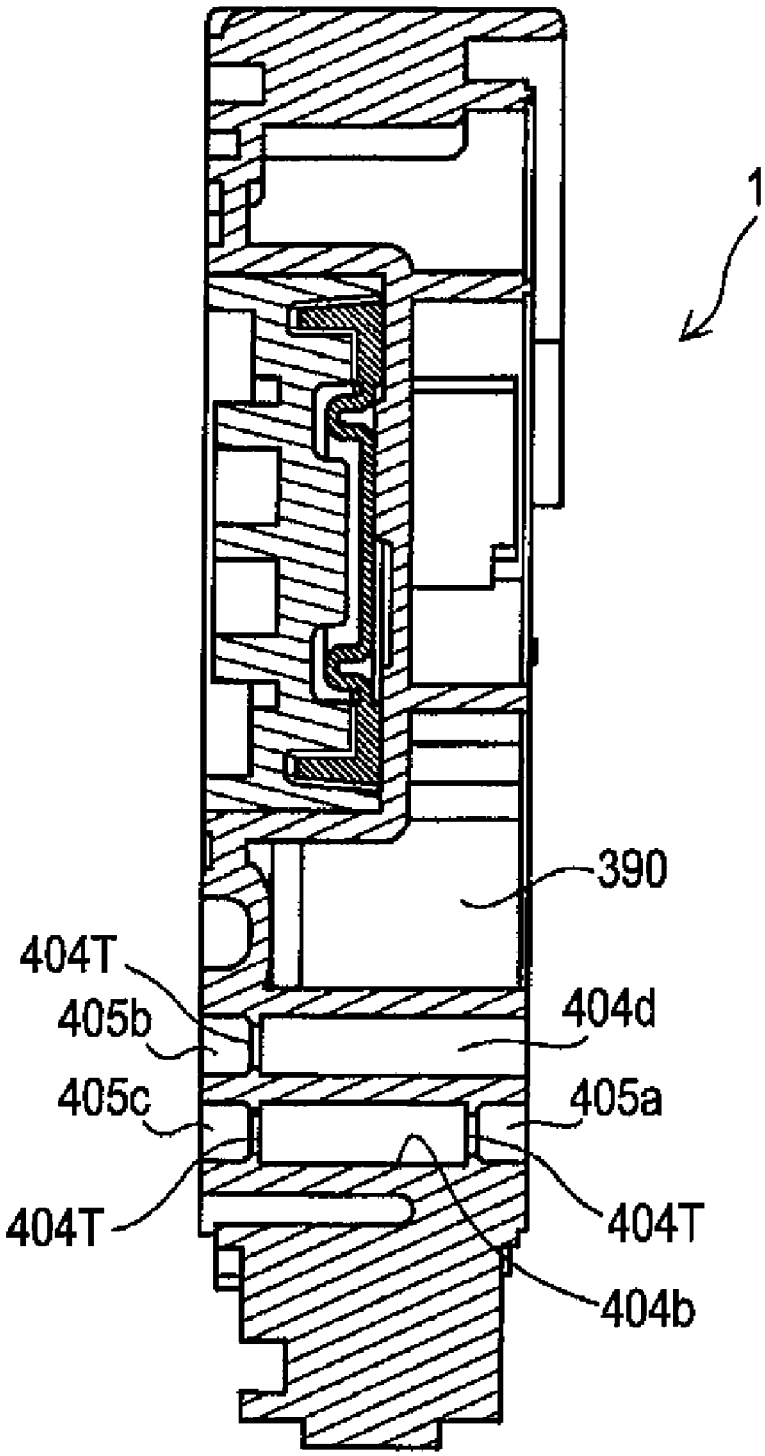
FIG. 7 is a cross-sectional view of the ink cartridge, taken along the line VII-VII in FIG. 11.
Figure 8:
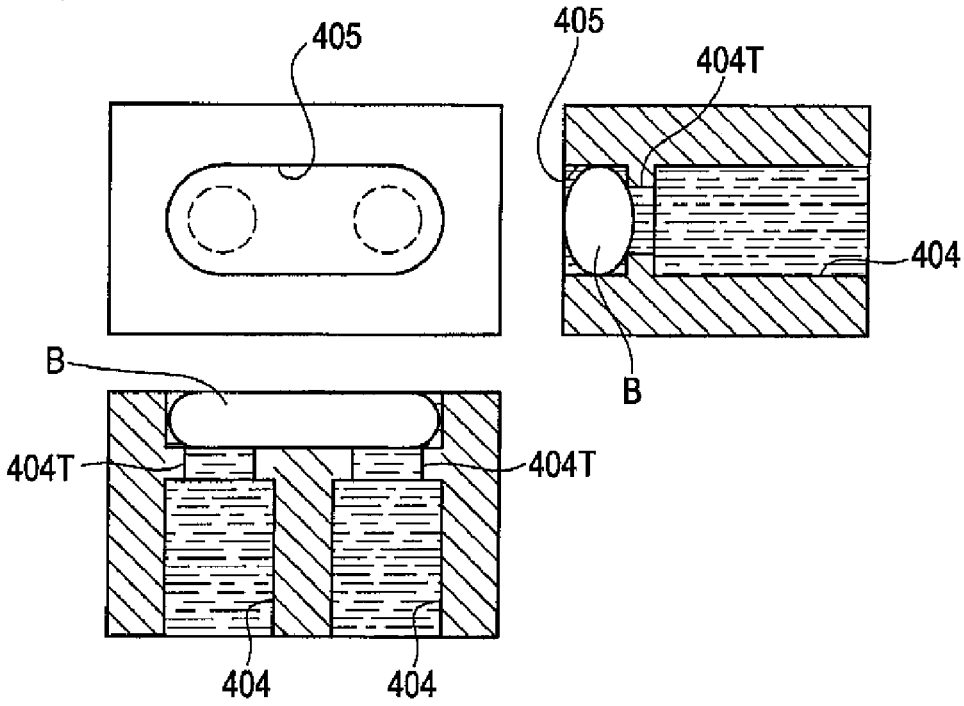
FIG. 8 is a diagram for describing some features of a vertical communication path according to the embodiment.
Figure 9:
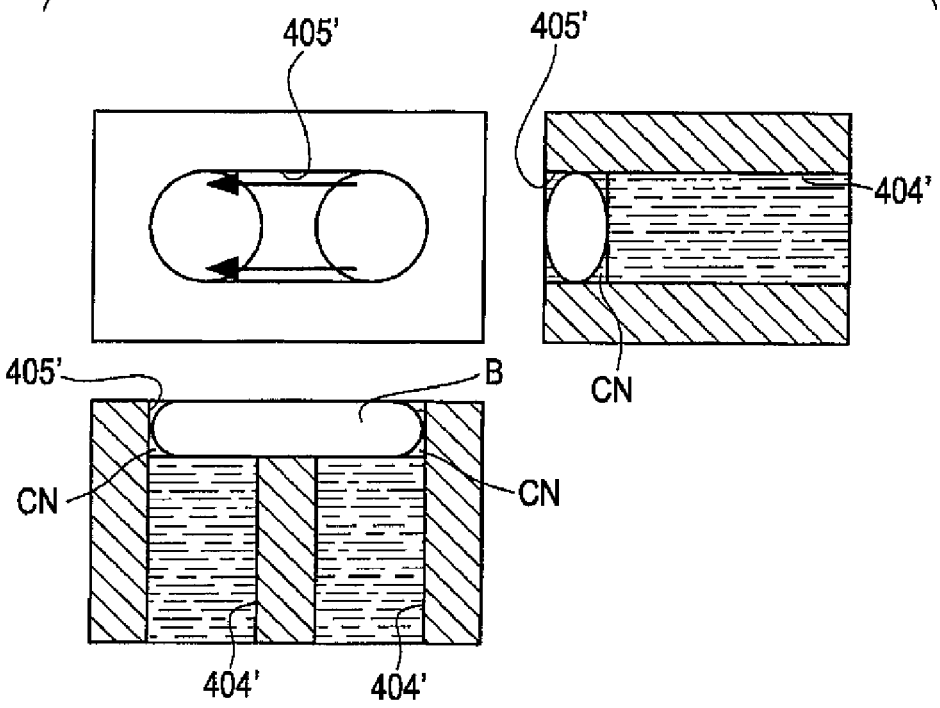
FIG. 9 shows a comparative example for describing the features of the vertical communication path according to the embodiment.
Figure 10:
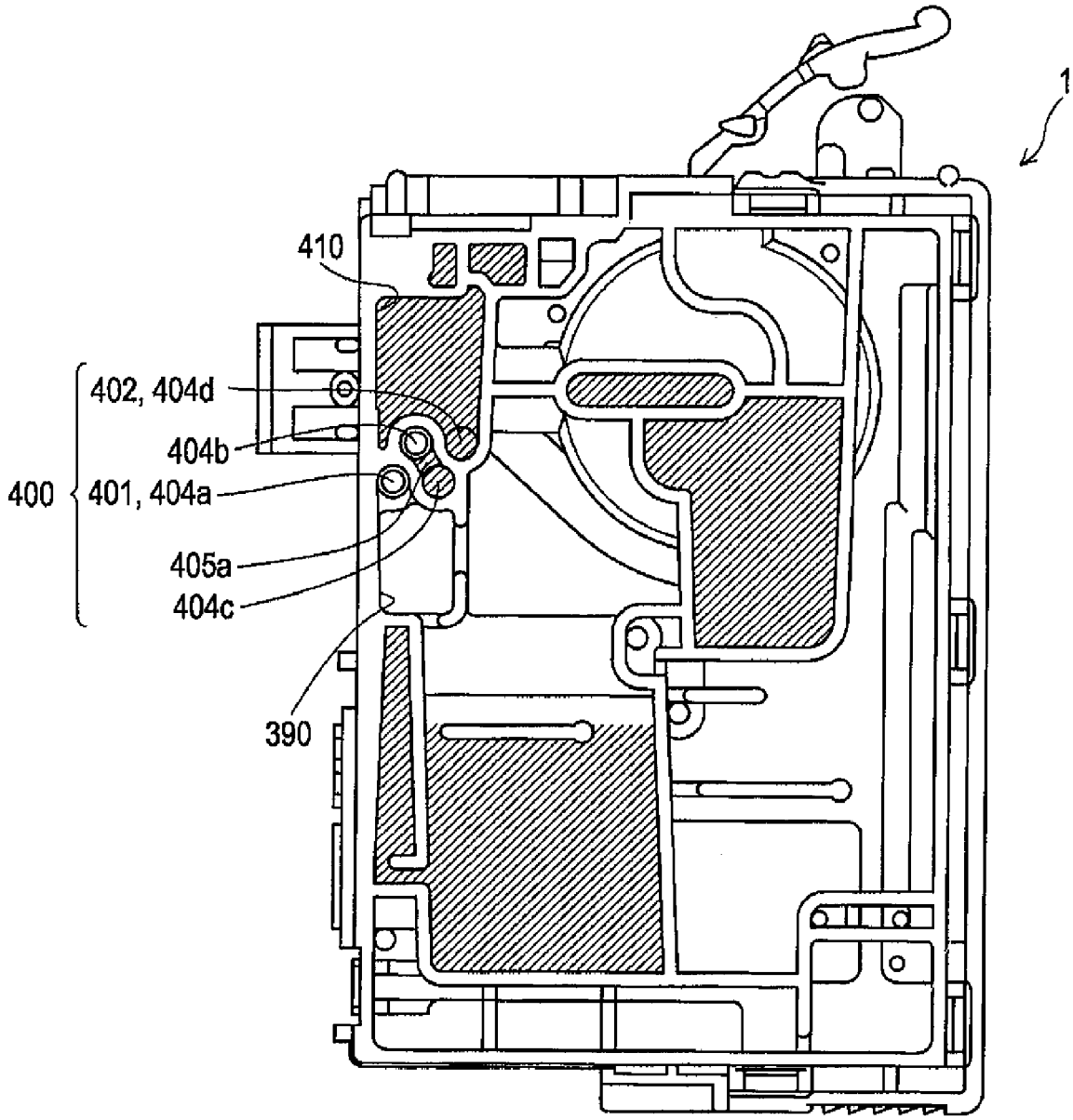
FIG. 10 is a diagram for describing the features of the vertical communication path in relation to the orientation of the ink cartridge according to the embodiment.

The vertical communication path 400 includes a plurality of bends, forming a three-dimensional structure having a back-and-forth structure and a going-up-one-step structure in combination. Details of the vertical communication path 400 will now be described with reference to FIGS. 7 to 10. FIG. 7 is a cross-sectional view of the ink cartridge 1, taken along the line VII-VII in FIG. 11, which will be described separately below. FIG. 8 is a diagram for describing some features of the vertical communication path 400 according to the embodiment. FIG. 9 shows a comparative example for describing the features of the vertical communication path 400 according to the embodiment. FIG. 10 is a diagram for describing the features of the vertical communication path 400 in relation to the orientation of the ink cartridge 1 according to the embodiment.

Figure 11:
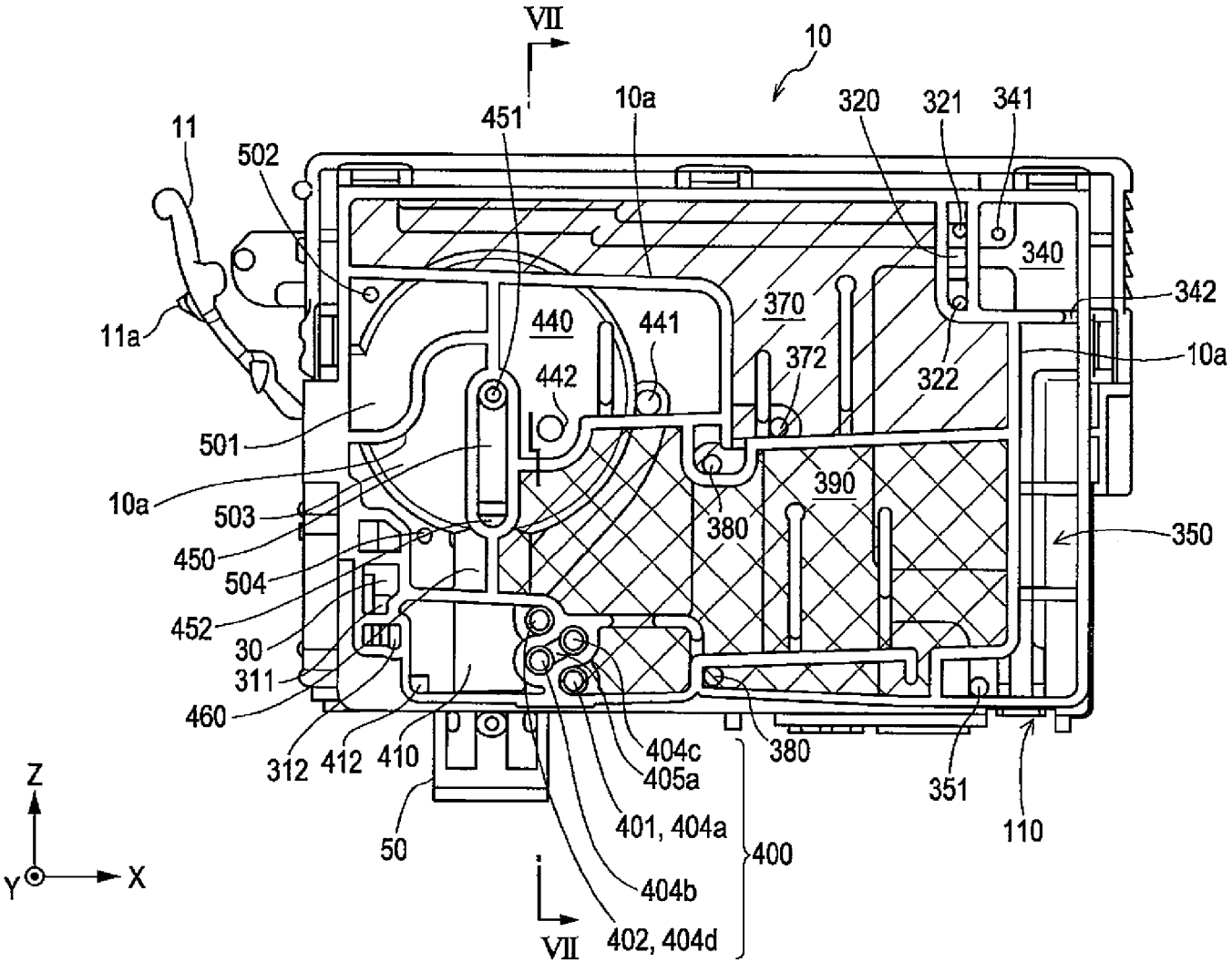
FIG. 11 is a front view of a cartridge body according to the embodiment.

The vertical communication path 400 includes first to fourth cylindrical segments 404*a* to 404*d* and first to third connecting segments 405*a* to 405*c*. Referring to FIGS. 8 and 11, the cylindrical segments 404*a* to 404*d* each extend in a direction intersecting the vertical direction and are arranged so as to be staggered with respect to the vertical direction. Specifically, the cylindrical segments 404*a* to 404*d* each extend parallel to the bottom face 1*b*, on which the liquid supply section 50 is provided, of the ink cartridge 1 across the thickness (the Y direction) of the ink cartridge 1, and are positioned at respectively different levels in the vertical direction (the height direction). In the embodiment, the cylindrical segments 404*a* to 404*d* are divided into two groups, each including two cylindrical segments overlapping in the vertical direction: a group of the first and third cylindrical segments 404*a* and 404*c*, and a group of the second and fourth cylindrical segments 404*b* and 404*d*. The vertical levels at which the cylindrical segments 404*a* to 404*d* are positioned become higher in order from the first cylindrical segment 404*a* to the fourth cylindrical segment 404*d*.

The connecting segments 405 (405*a* to 405*c*), which are provided on opposite sides of the ink cartridge 1, each extend obliquely upward and connect two of the cylindrical segments 404 (404*a* to 404*d*), whereby a single communication path extending from an entrance 401 to an exit 402, i.e., the vertical communication path 400, is provided. On the side where two of the connecting segments 405 are provided, the two connecting segments 405 extend parallel to each other, with each connecting segment 405 connecting two cylindrical segments 404 to each other. Specifically, on the front side shown in FIG. 11, one end of the second cylindrical segment 404*b* and one end of the third cylindrical segment 404*c* are connected to each other with the first connecting segment 405*a*. Further, on the back side shown in FIG. 12, one end of the first cylindrical segment 404*a* and the other end of the second cylindrical segment 404*b* are connected to each other with the second connecting segment 405*b*, and the other end of the third cylindrical segment 404*c* and one end of the fourth cylindrical segment 404*d* are connected to each other with the third connecting segment 405*c*. Thus, there is provided the vertical communication path 400 having a spirally-rising structure, namely, a combination structure of a back-and-forth structure and a going-up-stair structure, rising in the vertical direction from the entrance 401 to the exit 402. The first to third connecting segments 405*a* to 405*c* can serve as flow paths only when the outer surface film 60 and the film 80 are pasted thereover. In this respect, the first to third connecting segments 405*a* to 405*c* can also be referred to as first to third connecting-segment-forming portions. The first to third connecting segments 405*a* to 405*c* each desirably have a cross section without sharp edges, i.e., a semicircular or round cross section. A bubble that has entered a flow path tends to form a sphere because of its surface tension. If the flow path has a sharp edge, there may be a gap between the edge and a curved surface of the bubble, making it difficult to seal in the ink. With a flow path having a cross section without sharp edges, bubbles tend to form in conformity with the round shape of the flow path, eliminating the gap between the wall of the connecting segment and the surfaces of the bubbles. Thus, a phenomenon in which bubbles stay at certain positions while ink solely flows from the downstream side to the upstream side can be prevented.

The vertical communication path 400 having such a shape can reduce the probability that bubbles generated because of changes in outside environment, such as outside temperature or pressure, may enter the bubble separation chamber 410. A typical example is as follows. When the outside temperature drops and ink that fills the bubble separation chamber becomes frozen, the volume of the ink increases, and the frozen ink moves toward the end chamber. When the frozen ink melts, the volume of the ink returns to its original value, or is reduced. Depending on the orientation of the ink cartridge, when the frozen ink starts to melt, the entrance of the bubble separation chamber may touch a mass of air in the end chamber. If the melting of the frozen ink progresses in such a state, the air in the end chamber may flow into the bubble separation chamber, causing a problem of generation of bubbles in the bubble separation chamber. In the embodiment, to solve such a problem, the capacity of the vertical communication path 400 is set to be larger than the freezing-induced increment in the volume of ink that, in the unfrozen state, fills a range from the bubble separation chamber 410 to the buffer chamber 440. Thus, the ink that has frozen is kept within the vertical communication path 400 even after it melts. Consequently, entry of air (bubbles) into the bubble separation chamber 410 is suppressed or prevented. In addition, the buffer chamber 440 is designed considering the increment in the volume of ink.

Referring to FIGS. 7 and 8, the cylindrical segments 404 according to the embodiment include, at ends thereof connected to the connecting segments 405, narrow portions 404T having smaller diameters than the other portions of the cylindrical segments 404 and the connecting segments 405. Thus, the flow of ink from the connecting segments 405 to the cylindrical segments 404 is prevented or suppressed. The diameters of the other portions of the cylindrical segments 404 and the diameters of the connecting segments 405 may be the same. Alternatively, the diameters of the other portions of the cylindrical segments 404 may be larger or smaller than the diameters of the connecting segments 405.

Referring to FIG. 9, in a case of cylindrical segments 404' not including narrow portions, even if there is a bubble B in a connecting segment 405', the cylindrical segments 404' and the connecting segment 405' communicate with each other through a gap CN produced between the curved surface of the bubble B and the wall of the connecting segment 405'. This means that ink can flow between the end chamber and the bubble separation chamber through the gap CN. Therefore, when a pressure is applied to the ink from the downstream side (the side of the bubble separation chamber), the ink flows out toward the end chamber. Meanwhile, the bubble B stays in the connecting segment 405' because the ink can flow through the gap CN. Moreover, the bubble B is combined with other bubbles B coming from the upstream side, resulting in more bubbles B on the downstream side. Thus, bubbles often gather in such a vertical communication path.

In contrast, referring to FIG. 8 showing the case where the cylindrical segments 404 include the narrow portions 404T, since the narrow portions 404T have smaller diameters than the other portions of the cylindrical segments 404 and the connecting segments 405, a bubble B that has entered the connecting segment 405 has a larger diameter than the narrow portions 404T of the cylindrical segments 404. Therefore, the narrow portion 404T prevents the gap between the curved surface of the bubble B and the wall of the connecting segment 405 from communicating with the cylindrical segments 404, producing a state where the cylindrical segments 404 are sealed by the bubble B. That is, the bubble B that has entered the connecting segment 405 is pushed by the pressure applied thereto from the downstream side toward the cylindrical segment 404 on the upstream side, whereby the cylindrical segment 404 (the narrow portion 404T) is sealed by the bubble B. As a result, the ink cannot flow between the end chamber 390 and the bubble separation chamber 410. Thus, the flow of the ink into the end chamber 390 can be suppressed or prevented.

Further, referring to FIG. 10, the vertical communication path 400 has a configuration in which, even when the ink cartridge 1 is not oriented so as to be mounted in the ink jet printer, that is, when the ink cartridge 1 is not oriented such that the bottom face 1*b* thereof faces down, bubbles cannot move toward the bubble separation chamber 410 unless the bubbles move in the direction of gravity, or downward.

Specifically, when the ink cartridge 1 is oriented as in FIG. 10, the first connecting segment 405*a* and the third connecting segment 405*c* in combination form a V-shape. That is, the connecting segments 405 include at least a connecting segment A extending obliquely downward (in a first direction) from the bubble separation chamber 410 with respect to the vertical direction and a connecting segment B connected to the connecting segment A through a cylindrical segment and extending obliquely downward (in a second direction) in an axisymmetrical manner with respect to the connecting segment A.

With the vertical communication path 400 having such a configuration, movement (flow) of bubbles into the bubble separation chamber 410 can be suppressed or prevented, regardless of the orientation of the ink cartridge 1 that has been removed from the ink jet printer. More specifically, when the ink cartridge 1 is oriented so as to be mounted in the ink jet printer, the entrance 401 of the vertical communication path 400 resides at the bottommost position of the end chamber 390 and is not exposed to air; in fact, bubbles do not move inside the vertical communication path 400. Even when the ink cartridge 1 is oriented in any other way, bubbles cannot move toward the bubble separation chamber 410 unless the bubbles move downward in the direction of gravity. Accordingly, movement of the bubbles can be suppressed or prevented. Thus, regardless of the orientation of the ink cartridge 1 when stored, movement of bubbles from the vertical communication path 400 to the bubble separation chamber 410 can be suppressed or prevented.

The bubble separation chamber 410 communicates with the first flow path 420 through a communication hole 412 (refer to FIG. 11) provided in the wall of the bubble separation chamber 410. The first flow path 420 communicates at the downstream end thereof with the sensor section 30. The bubble separation chamber 410 separates bubbles from ink that has flowed therein from the vertical communication path 400, thereby suppressing or preventing movement of bubbles into the sensor section 30. Specifically, with the exit 402 of the vertical communication path 400 provided at an upper position (in the Z direction) and the first flow path 420 connected at a lower position of the bubble separation chamber 410, the bubble separation chamber 410 introduces ink from the exit 402 and sends the ink through the first flow path 420 to the sensor section 30. With such a configuration, the ink containing bubbles and flowing from the vertical communication path 400 into the bubble separation chamber 410 is separated into a gas component, i.e., the air contained in the ink, which is trapped in the upper portion of the bubble separation chamber 410, and a liquid component, i.e., the ink, which runs down the inner wall of the bubble separation chamber 410 to the lower portion of the bubble separation chamber 410. In short, according to the difference in specific gravity between gas and liquid, bubbles are trapped in the upper portion of the bubble separation chamber 410. If either air or ink is eliminated, no bubbles are generated. Therefore, by separating air and ink, a problem of misdetection by the remaining-liquid-amount sensor 31 due to entry of bubbles into the sensor section 30 can be suppressed or prevented. Possible misdetections are as follows. In one case, although some ink still remains in the ink cartridge 1, ink shortage may be detected because of bubbles that have entered the sensor section 30. In another case, although there is substantially no ink in the ink cartridge 1, the presence of ink may be detected because a slight amount of ink barely remaining therein is drawn together with air into the sensor section 30, as a liquid containing bubbles, by capillary action. In the former case, although there is still some ink, printing cannot be performed. In the latter case, although there is no ink, printing is performed and the printhead may be damaged.

The second flow path 430 communicates at the upstream end thereof with the sensor section 30, and at the downstream end thereof with the buffer chamber 440. A stirring ball may be provided in the buffer chamber 440. In that case, the stirring ball moves with the flow of ink and the reciprocating movement of the ink cartridge 1 in the main scanning direction, thereby stirring ink in the buffer chamber 440. Thus, sedimentation of some of ink components can be prevented, and ink characteristics are maintained to be uniform. The buffer chamber 440 directly communicates with the differential-pressure-valve-housing chamber 40*a* through a communication hole 442 provided in the wall of the buffer chamber 440, with no flow paths interposed therebetween. Thus, the space ranging from the buffer chamber 440 to the liquid supply section 50 is reduced, whereby the probability that ink that has been stirred and has gathered therein will form sediment can be reduced. In the differential-pressure-valve-housing chamber 40*a*, the differential pressure valve 40 adjusts the ink pressure in a region on the downstream side with respect to the differential-pressure-valve-housing chamber 40*a* to be lower than the ink pressure in a region on the upstream side so that the ink stored in the downstream region is subjected to a negative pressure. Thus, the backward flow of ink is prevented. The third flow path 450 communicates at the upstream end thereof with the differential-pressure-valve-housing chamber 40*a*, and at the downstream end thereof with the liquid supply section 50.

At the completion of manufacture of the ink cartridge 1, referring to the conceptual diagram shown in FIG. 6, the range up to the tank chamber 370, as indicated by a dashed line ML1 representing the ink surface (the interface between air and ink) is filled with ink. When the ink in the ink cartridge 1 is consumed by the ink jet printer, the ink surface moves toward the downstream region, and air flows into the ink cartridge 1, from the upstream region through the air release hole 100. Accordingly, the ink surface is lowered in the vertical direction. When the ink is consumed more, the interface between air and ink reaches the sensor section 30, as indicated by a dashed line ML2 shown in the conceptual diagram in FIG. 6.

The entry of air into the sensor section 30 is detected as ink shortage by the remaining-liquid-amount sensor 31. Specifically, as described above, the remaining-liquid-amount sensor 31 outputs detection result signals having different signal waveforms (resonance frequencies) between the case where air is present in the sensor section 30 (a case where bubbles are contained in the ink) and the case where air is absent in the sensor section 30 (a case where ink fills the sensor section 30). When ink shortage is detected in accordance with the corresponding detection result signal, the ink jet printer stops printing before the ink in the downstream region (including the buffer chamber 440 and so forth) of the ink cartridge 1 with respect to the sensor section 30 is completely consumed, and notifies the user of ink shortage. This is because, if printing is performed after the ink is completely consumed, air flows into the printhead, causing so-called blank ejection that may lead to failure in the printhead.

Figure 12:
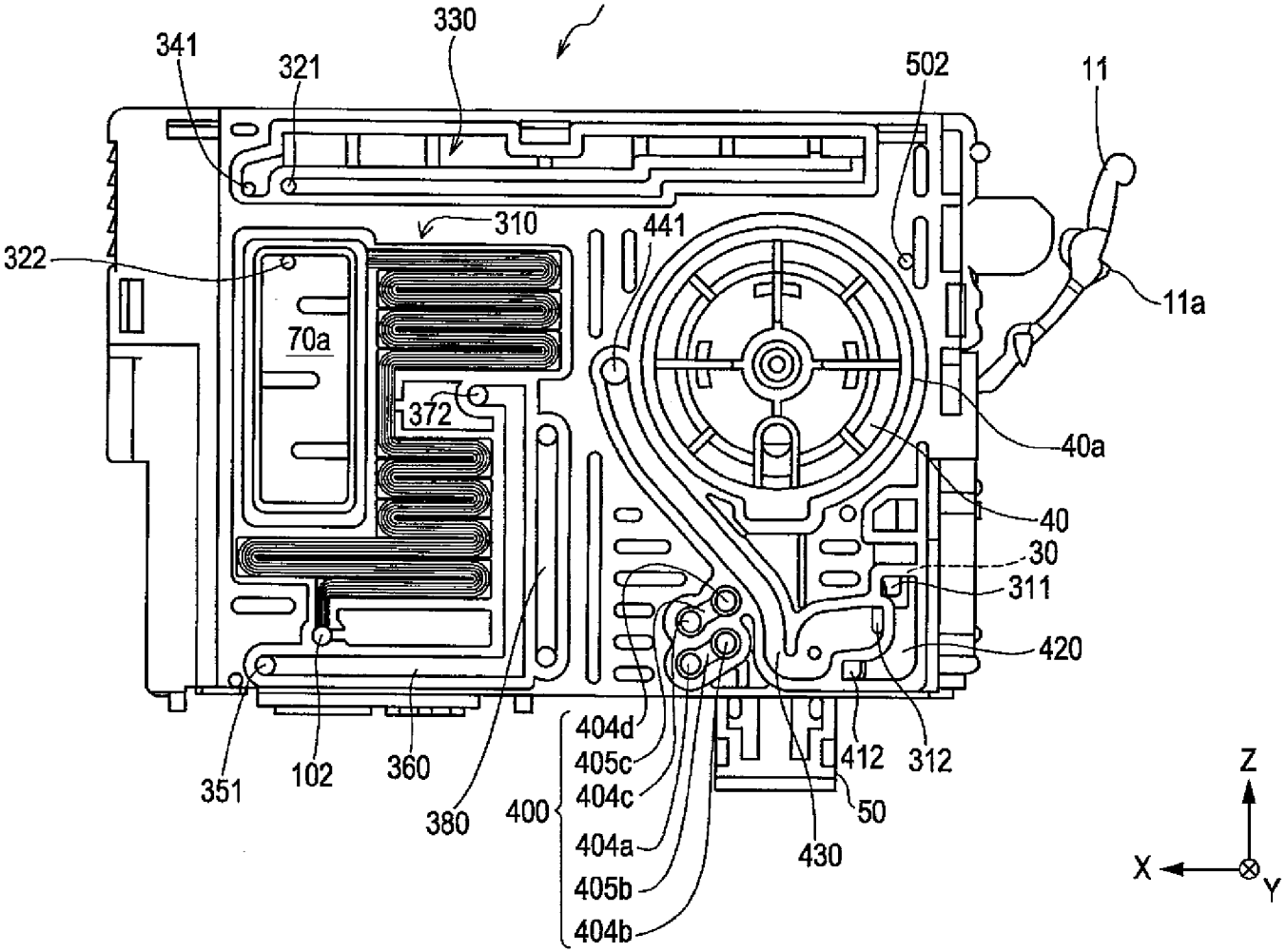
FIG. 12 is a back view of the cartridge body according to the embodiment.
Figure 13A:
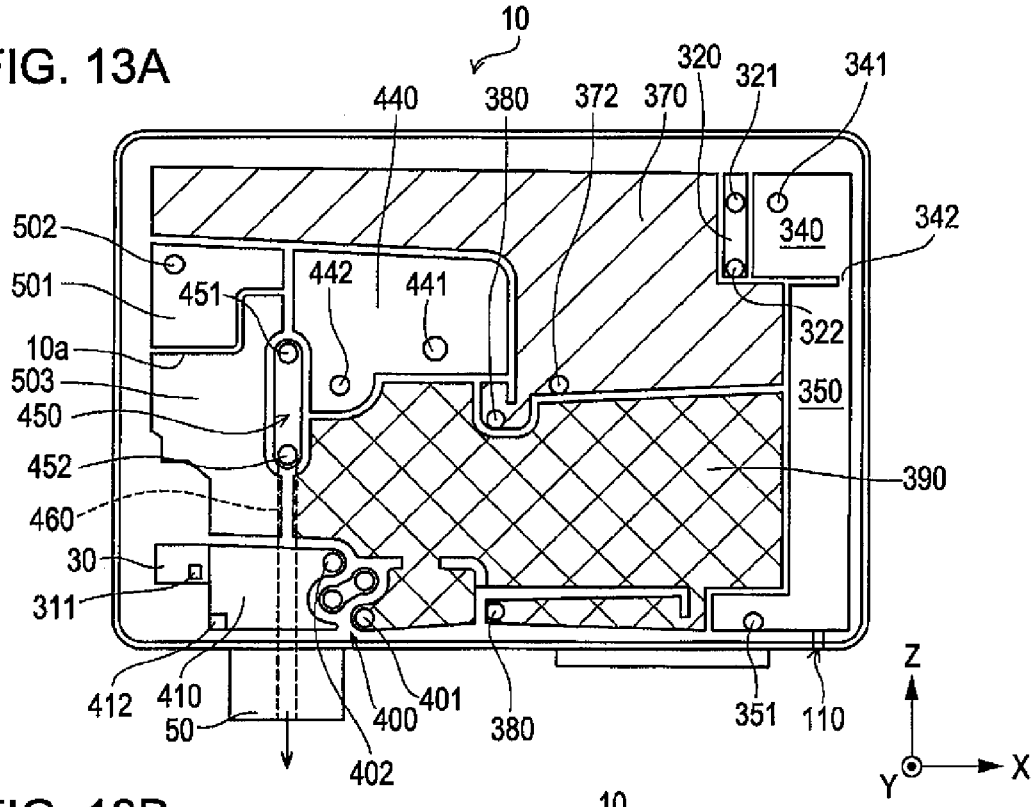
FIG. 13A is a simplified diagram corresponding to FIG. 11.
Figure 13B:
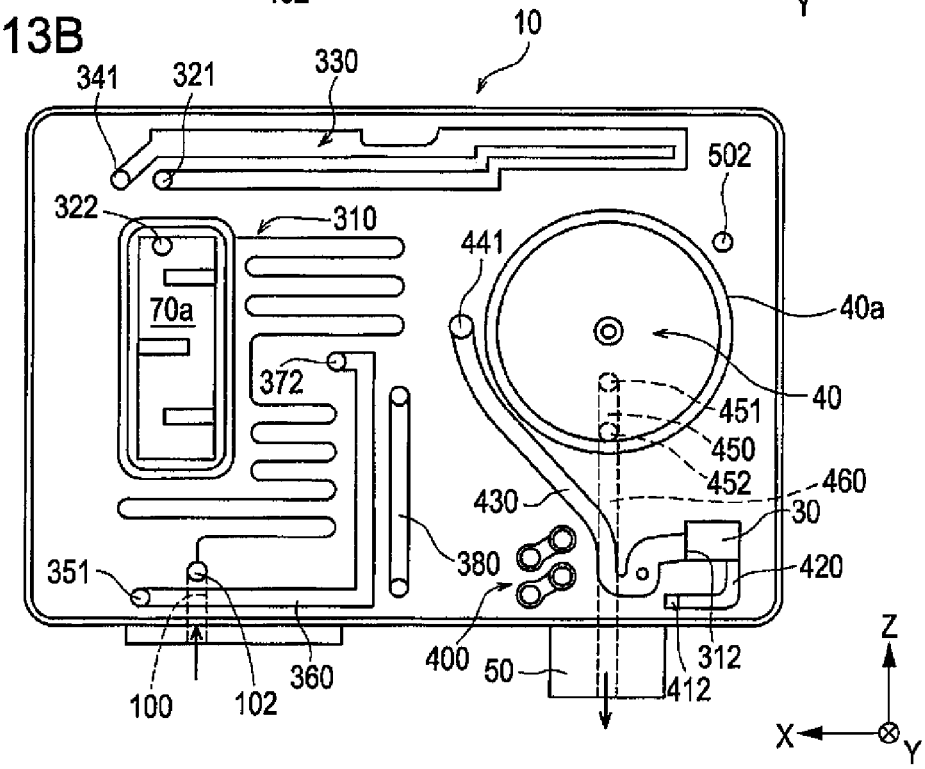
FIG. 13B is a simplified diagram corresponding to FIG. 12.

Based on the above description, the specific configurations of relevant elements provided inside the ink cartridge 1, in the range from the air release hole 100 to the liquid supply section 50, will now be described with reference to FIGS. 11 to 13B. FIG. 11 is a front view of the cartridge body 10. FIG. 12 is a back view of the cartridge body 10. FIG. 13A is a simplified diagram corresponding to FIG. 11. FIG. 13B is a simplified diagram corresponding to FIG. 12.

The tank chamber 370 and the end chamber 390 included in the ink storage section are provided on the front side of the cartridge body 10. The tank chamber 370 and the end chamber 390 are shown in a single-hatched manner and a cross-hatched manner, respectively, in FIGS. 11 and 13A. The tank chamber 370 is provided between the air release hole 100 and the liquid supply section 50 and immediately below a top panel of the cartridge body 10, i.e., at an upper region or the topmost region of the cartridge body 10. The end chamber 390 is provided between the air release hole 100 and the liquid supply section 50 and immediately above a bottom panel of the cartridge body 10, i.e., at a lower region or the bottommost region of the cartridge body 10. Referring to FIGS. 12 and 13B, the inter-chamber communication path 380 is provided near the center on the back side of the cartridge body 10. The inter-chamber communication path 380 allows the tank chamber 370 and the end chamber 390 to communicate with each other, with the upstream end thereof connected to the tank chamber 370 and the downstream end thereof connected to the end chamber 390. Referring to FIGS. 11 and 13A, the upstream end of the inter-chamber communication path 380 is connected to the bottommost position of the tank chamber 370.

Referring to FIGS. 12 and 13B, the meandering path 310 and the air-liquid separation chamber 70*a* included in the air introduction section are provided on the back-right side of the cartridge body 10. A communication hole 102 allows the upstream end of the meandering path 310 and the air release hole 100 to communicate with each other. The downstream end of the meandering path 310 extends through a sidewall of the air-liquid separation chamber 70*a*, whereby the meandering path 310 communicates with the air-liquid separation chamber 70*a*.

The first to fifth air chambers 320 to 360 included in the air introduction section shown in FIG. 6 will now be described in detail. Referring to FIGS. 11 and 13A, the first, third, and fourth air chambers 320, 340, and 350 are provided on the front side of the cartridge body 10. Referring to FIGS. 12 and 13B, the second and fifth air chambers 330 and 360 are provided on the back side of the cartridge body 10. The air chambers 320 to 360 are connected in series in order of their reference numerals from the upstream side, thereby forming a single path. The air chambers 320 and 330 are provided immediately below the top panel of the cartridge body 10. The air chambers 340 and 350 are provided adjoining a right side panel of the cartridge body 10. A communication hole 322 allows the air-liquid separation chamber 70*a* and the air chamber 320 to communicate with each other. A communication hole 321 allows the air chambers 320 and 330 to communicate with each other. A communication hole 341 allows the air chambers 330 and 340 to communicate with each other. The air chambers 340 and 350 communicate with each other through a notch 342 in one of the ribs 10*a* provided therebetween. A communication hole 351 allows the air chambers 350 and 360 to communicate with each other. A communication hole 372 allows the air chamber 360 and the tank chamber 370 to communicate with each other. With the first to fifth air chambers 320 to 360 provided three-dimensionally, the backward flow of ink from the tank chamber 370 toward the air-liquid separation chamber 70*a* can be suppressed.

Referring to FIGS. 11 and 13A, the vertical communication path 400 and the bubble separation chamber 410 included in the ink flow path section are provided on the front side of the cartridge body 10 and near the liquid supply section 50. The vertical communication path 400 has the entrance 401 connected at the bottommost position of the end chamber 390, and the exit 402 connected at the topmost position of the bubble separation chamber 410. The vertical communication path 400 extends back and forth between the back end and the front end of the cartridge body 10 twice, and ultimately allows the end chamber 390 and the bubble separation chamber 410 to communicate with each other. Referring to FIGS. 11 to 13B, the sensor section 30 is provided in a lower region on the left side of the cartridge body 10, as described above with reference to FIG. 4.

Referring to FIGS. 12 and 13B, the first flow path 420, which allows the bubble separation chamber 410 and the sensor section 30 to communicate with each other, and the second flow path 430, which allows the sensor section 30 and the buffer chamber 440 to communicate with each other, are provided on the back side of the cartridge body 10. The bubble separation chamber 410 has at the bottom thereof the communication hole 412, through which the bubble separation chamber 410 and the first flow path 420 communicate with each other. A communication hole 311 allows the first flow path 420 and the sensor section 30 to communicate with each other. A communication hole 312 allows the sensor section 30 and the second flow path 430 to communicate with each other. A communication hole 441 allows the second flow path 430 and the buffer chamber 440 to communicate with each other.

Referring to FIGS. 11 and 13A, the buffer chamber 440, the third flow path 450, and the fourth flow path 460 are provided on the front-left side of the cartridge body 10. The communication hole 441 allows the downstream end of the second flow path 430 and the buffer chamber 440 to communicate with each other. A communication hole 442 is provided at the bottom of the buffer chamber 440, thereby allowing the buffer chamber 440 and the differential-pressure-valve-housing chamber 40*a* to directly communicate with each other. A communication hole 451 allows the differential-pressure-valve-housing chamber 40*a* and the third flow path 450 to communicate with each other. A communication hole 452 allows the third flow path 450 and the fourth flow path 460, which is provided inside the liquid supply section 50, to communicate with each other.

The upstream end of the inter-chamber communication path 380, the entrance 401, the communication hole 412, and the communication hole 442 are provided at the bottoms of the tank chamber 370, the end chamber 390, the bubble separation chamber 410, and the buffer chamber 440, respectively. This is to position the forgoing holes on the lower sides, in the vertical direction, of the tank chamber 370, the end chamber 390, the bubble separation chamber 410, and the buffer chamber 440, respectively, when the ink cartridge 1 is mounted on the carriage 200 with the bottom face 1*b* of the ink cartridge 1 vertically facing down. With such a configuration, even when the amount of remaining ink becomes smaller with ink consumption, ink is not trapped inside the foregoing chambers, avoiding waste of ink. Moreover, since bubbles move upward in the vertical direction, bubbles do not easily move toward the downstream side.

Referring to FIGS. 11 and 13A, unfilled chambers 501 and 503, in which no ink is supplied, are independent chambers provided off the path extending from the air release hole 100 to the liquid supply section 50. Air communication holes 502 and 504, which allow outside-air passage therethrough, are provided at the backs of the unfilled chambers 501 and 503, respectively. When the ink cartridge 1 is packaged by reduced-pressure packaging, the unfilled chambers 501 and 503 serve as deaerating chambers in which negative pressure is accumulated. Thus, the ink cartridge 1 in the packaged state can maintain the pressure inside the cartridge body 10 below a specified value, whereby ink containing less dissolved air can be supplied.

As described above, the vertical communication path 400 of the ink cartridge 1 according to the embodiment includes the entrance 401 provided at a low level in the vertical direction and connected to the end chamber 390 and the exit 402 provided at a higher level than the entrance 401 and connected to the bubble separation chamber 410. Therefore, movement of bubbles from the end chamber 390 to the bubble separation chamber 410 can be suppressed or prevented. Consequently, misdetection of the amount of ink occurring because of bubbles that have entered the sensor section 30 can be suppressed or prevented.

Further, the vertical communication path 400 according to the embodiment is obtained by the pasting of the outer surface film 60 and the film 80 performed to obtain the complete form of the ink cartridge 1. Therefore, unlike the known ink cartridge, provision of dedicated films is unnecessary. Moreover, the vertical communication path 400 can be formed by a simple manufacturing process in which the cylindrical segments 404 are formed by boring and the connecting segments 405 are provided such that the cylindrical segments 404 are connected to one another. Consequently, the process of manufacturing the ink cartridge 1 can be simplified, and the cost of manufacturing the ink cartridge 1 can be reduced. In addition, most of the vertical communication path 400 has a round cross section (a cross section without sharp edges). Therefore, unexpected flow of ink occurring because the shapes of bubbles do not change in conformity with the sharp edges can be suppressed or prevented.

Furthermore, the vertical communication path 400 according to the embodiment has a combination structure of a back-and-forth structure and a going-up-stair structure, and rises spirally in the vertical direction. Therefore, regardless of the orientation of the ink cartridge 1, movement of bubbles from the end chamber 390 to the bubble separation chamber 410 can be suppressed or prevented. More specifically, the vertical communication path 400 has a configuration in which, when the ink cartridge 1 is not oriented so as to be mounted in the ink jet printer, that is, when the ink cartridge 1 is not oriented such that the bottom face 1*b* thereof faces down, bubbles cannot move toward the bubble separation chamber 410 unless the bubbles move in the direction of gravity. Therefore, air, or bubbles, having a smaller specific gravity (a smaller density) than ink, or liquid, cannot move toward the bubble separation chamber 410 unless the ink flows toward the bubble separation chamber 410. In the state where the ink cartridge 1 has been removed from the ink jet printer, the ink in the ink cartridge 1 does not flow because the ink is not drawn through the liquid supply section 50. In the state where the ink cartridge 1 is mounted on the ink jet printer, the entrance 401 of the vertical communication path 400 residing at the bottommost position of the end chamber 390 is exposed to the ink. This means that, entry of bubbles (air), other than the bubbles that have entered the vertical communication path 400 because the entrance 401 is exposed to air when the ink cartridge 1 is not oriented so as to be mounted on the ink jet printer, into the bubble separation chamber 410 can be suppressed or prevented. It should be noted that the vertically rising back-and-forth shape of the vertical communication path 400 can also be interpreted as a configuration in which, in the state where the ink cartridge 1 is not oriented such that the bottom face 1*b* thereof faces down, movement of bubbles contained in the liquid therein toward the bubble separation chamber is suppressed. In addition, the configuration that suppresses the movement of bubbles toward the bubble separation chamber can be interpreted as a configuration including a portion that, in the state where the ink cartridge 1 is not oriented such that the bottom face 1*b* thereof faces down, extends downward in the direction of gravity.

Further, the cylindrical segments 404 of the vertical communication path 400 according to the embodiment includes the narrow portions 404T. Therefore, even if bubbles are generated in the connecting segments 405, the flow of ink from the bubble separation chamber 410 toward the end chamber 390 can be suppressed or prevented.

Other Embodiments (1) The above embodiment concerns the case where four cylindrical segments 404*a* to 404*d* are provided. Alternatively, two cylindrical segments and one connecting segment may only be provided. Also in that case, the above-described advantages, such as suppression or prevention of the movement of bubbles from the vertical communication path 400 toward the bubble separation chamber 410 and suppression or prevention of the flow of ink from the bubble separation chamber 410 toward the end chamber 390, as well as various other advantages, described above, brought by the vertical communication path 400 can be enjoyed. Moreover, five or more cylindrical segments may be provided. With the increase in the number of the cylindrical segments, the assuredness in suppressing or preventing the movement of bubbles into the bubble separation chamber 410 can be improved.

(2) The above embodiment concerns the case where the ink storage section, corresponding to a liquid storage section, includes two chambers: the tank chamber 370 and the end chamber 390. Alternatively, one of the two chambers may only be included in the liquid storage section. In that case, the number of partitions provided in the ink cartridge 1 can be reduced.

(3) The above embodiment concerns the case where the vertical communication path 400 is obtained by the pasting of the outer surface film 60 and the film 80. Alternatively, the vertical communication path 400 may be substituted by another member having a spirally extending groove. In that case, the spiral member is inserted or screwed into the cartridge body 10 such that the entrance 401 and the end chamber 390 communicate with each other and the exit 402 and the bubble separation chamber 410 communicate with each other. In such a configuration, the vertical communication path 400 can be obtained without using a film that is susceptible to changes in outside pressure or temperature. Therefore, generation and movement of bubbles due to outside environment can be suppressed or prevented.

(4) The above embodiment concerns the case of an ink jet printer serving as a liquid ejecting apparatus. Alternatively, any other liquid ejecting apparatus is acceptable that ejects or sprays liquid other than ink (a solution in which particles of a functional material are dispersed or a gel material) or a fluid other than liquid (a solid material that is ejectable as a fluid). Examples of such a liquid ejecting apparatus include a liquid ejecting apparatus that ejects a liquid material, such as an electrode material or a colorant, used in manufacturing a liquid crystal display, an electroluminescent (EL) display, a surface emission display, a color filter, or the like; a liquid ejecting apparatus that ejects a bio-organic substance used for manufacturing a biochip; a liquid ejecting apparatus, serving as a precision pipette, that ejects a liquid material as a sample; a liquid ejecting apparatus that ejects lubricant to a precision instrument, such as a clock or a camera, with pinpoint accuracy; a liquid ejecting apparatus that ejects toward a substrate transparent resinous liquid, such as ultraviolet-curable resin, for forming a micro-hemispherical lens (an optical lens) intended for optical communications devices and the like; a liquid ejecting apparatus that ejects etching liquid composed of acid, alkali, or the like for etching a substrate or the like; a fluid ejecting apparatus that ejects a gel material; and a power-jet-type recording apparatus that ejects a solid material such as powder toner.

The embodiments of the invention and variations thereof described above only help easy understanding of the invention and do not limit the invention. Various modifications and improvements can be made to the invention without departing from the scope and claims thereof, and various equivalents thereof are also within the scope of the invention.

What is claimed is:

1. A liquid container mountable in a liquid ejecting apparatus, the liquid container comprising:

a liquid storage section that stores liquid;

a liquid supply section through which the liquid stored in the liquid storage section is supplied to the liquid ejecting apparatus;

an air communication section that allows the liquid storage section and an outside of the liquid container to communicate with each other;

a bubble separation section that separates bubbles from the liquid;

a vertical communication path that has an entrance communicating with the liquid storage section and an exit communicating with the bubble separation section; and a detection section that communicates with the liquid supply section and the bubble separation section, adapted to detect a depletion of the liquid stored in the liquid container by detecting when the detection section becomes filled with air;

wherein the vertical communication path includes a plurality of cylindrical segments that each extend in a direction intersecting the vertical direction, and at least one connecting segment that connects the plurality of cylindrical segments to each other so as to obtain a single flow path, the vertical communication path being located downstream of the liquid storage section and upstream of the detection section through the bubble separation section.

2. The liquid container according to claim 1, wherein the exit of the vertical communication path is provided at a higher level in a vertical direction than the entrance of the vertical communication path.

3. The liquid container according to claim 1, wherein the plurality of cylindrical segments are staggered with respect to the vertical direction.

4. The liquid container according to claim 3, wherein the cylindrical segments each have at one end thereof a narrow portion having a smaller cross section, intersecting a flow direction, than the other portions of the cylindrical segments.

5. The liquid container according to claim 1, wherein the vertical direction corresponds to a direction in which, in a state where the liquid container is mounted in the liquid ejecting apparatus, a bottom face of the liquid container having the liquid supply section faces downward.

6. The liquid container according to claim 5, wherein, in an orientation of the liquid container other than an orientation where the bottom face faces downward, the vertical communication path has a bubble-movement-suppressing configuration in which movement of bubbles contained in the liquid therein into the bubble separation chamber is suppressed.

7. The liquid container according to claim 6, wherein the bubble-movement-suppressing configuration includes a portion that, in the orientation of the liquid container other than the orientation where the bottom face faces downward, extends downward in a direction of gravity.

8. The liquid container according to claim 2, wherein the vertical communication path has a spirally rising shape extending from the entrance to the exit.

* * * * *